US006053736A

United States Patent [19]

Huffman et al.

[11] Patent Number: 6,053,736

[45] Date of Patent: Apr. 25, 2000

[54] INTERACTIVE TRAINING SYSTEM FOR AWACS WEAPONS DIRECTORS

[75] Inventors: Stephen D. Huffman; Bruce C. Montag; Sharon D. Long, all of San Antonio, Tex.

[73] Assignee: Southwest Research Institute, San Antonio, Tex.

[21] Appl. No.: 08/951,958

[22] Filed: Oct. 17, 1997

[51] Int. Cl.[7] ..... F41A 33/00

[52] U.S. Cl. ..... 434/11; 434/14; 434/20; 434/21; 434/43; 395/500.29; 342/13

[58] Field of Search ..... 434/11, 14, 20, 434/29, 30, 35, 42, 43, 55, 307 R, 308, 365, 372; 701/14, 208, 213, 220, 225, 301; 342/13, 29, 159, 160, 189, 195, 450, 458, 462; 348/121, 123; 340/961, 945; 382/260; 712/11, 14, 15; 244/75 R, 3.11, 3.16, 3.19; 89/1.1, 1.11; 395/500.24, 500.29, 500.41

[56] References Cited

U.S. PATENT DOCUMENTS

| | | | |
|---|---|---|---|
| 3,996,672 | 12/1976 | Osofsky et al. | 434/43 |
| 4,433,334 | 2/1984 | Caputi, Jr. | 342/450 |
| 4,457,716 | 7/1984 | Eserhaut et al. | 434/43 |
| 4,672,380 | 6/1987 | Bryant et al. | 342/92 |
| 4,954,837 | 9/1990 | Baird et al. | 701/208 X |
| 5,017,141 | 5/1991 | Relf et al. | 434/29 |
| 5,144,316 | 9/1992 | Uhlmann et al. | 342/189 |
| 5,224,861 | 7/1993 | Glass et al. | 244/118.5 X |
| 5,313,201 | 5/1994 | Ryan | 340/961 |
| 5,378,155 | 1/1995 | Eldridge | 434/11 |
| 5,458,041 | 10/1995 | Sun et al. | 89/1.11 |
| 5,587,904 | 12/1996 | Ben-Yair et al. | 701/213 |
| 5,590,345 | 12/1996 | Barker et al. | 712/11 |
| 5,644,508 | 7/1997 | McNary et al. | 382/260 X |

*Primary Examiner*—Joe H. Cheng
*Attorney, Agent, or Firm*—Baker & Botts, L.L.P.

[57] ABSTRACT

A training system for training AWACS weapons directors. The training system is programmed so that the student can select between a number of different training modes. These include interactive courseware, simulation, and live exercise modes. The system includes a voice recognition unit that is trained to recognize AWACS terminology and to interactively teach them.

20 Claims, 2 Drawing Sheets

INTERACTIVE TRAINING SYSTEM FOR AWACS WEAPONS DIRECTORS

GOVERNMENT RIGHTS

This invention was made with government support under government contract number F41689-95-C-0503, with the Air Education and Training Command, a division of the United States Air Force. The government has certain rights in the invention.

TECHNICAL FIELD OF THE INVENTION

The present invention relates generally to an innovative approach to computer-based interactive training systems, and more particularly to a multi-mode single-platform system especially designed for training weapons directors for the Air Force's Airborne Warning and Control System (AWACS).

BACKGROUND OF THE INVENTION

Three-dimensional computer graphics is increasingly being used in job skills training systems. Flight simulators are but one example. Today's flight training simulators make use of three-dimensional graphic software and hardware, which have become both more affordable and versatile.

Today's computer-based training systems are often implemented as interactive and progressive teaching simulations, referred to as "interactive courseware". When interactive courseware is combined with three-dimensional graphics, the effectiveness of training systems is vastly enhanced. For example, a unique capability of three-dimensional interactive courseware is that the student can completely control objects on the screen. The student can follow any eye pattern within the model space. In other words, the student can view an object from the top, turn it around, move it, and so on. For example, the United States Air Force has used interactive courseware that permits the student to manipulate radar beams or to view complex radar concepts in three-dimensions.

As interactive courseware becomes more sophisticated, it becomes better able to meet the demands of training persons for highly technical skills. One example of technical expertise for which training needs have not yet been met by interactive courseware is the expertise required for the Air Force's Airborne Warning and Control System (AWACS). This system comprises radar equipment carried on E-3 Sentry aircraft.

The operators of AWACS systems, referred to as "weapons directors", perform tasks that are similar to those of a flight controller but that are far more complicated. Specifically, a weapons director has the additional responsibility of enhancing the combat capability to the fighters he controls. Not only does be transmit data about aircraft location, direction, and speed, he also communicates command directives, mission modifications, weather updates, airfield closures, refueling information, and coordination between other fighting elements both airborne and on the ground. He must know what information that pilot needs and be able to provide it at the appropriate time. The weapons director must learn to read a two-dimensional radar display, listen to communications from pilots, and from that, recognize what is occurring. In short, a weapons director must attain the knowledge and develop the decision-making abilities required to direct fighters in combat.

To date, AWACS weapons directors have been required to learn these skills in live training or during actual combat missions. This has led to inadequate training, with tragic and avoidable mishaps.

SUMMARY OF THE INVENTION

One aspect of the invention is a single-platform multi-mode training system for training students to be weapons directors of an AWACS system. The system has at least one student console, which is a replica of an AWACS console. A memory stores programming for different training modes, specifically, interactive courseware programming, simulation programming, and live exercise programming. A host computer handles the transfer of data for simulation and live exercise modes, specifically, by receiving flight data from an external flight simulator, radar data, and audio data from pilots of simulated aircraft. A digital audio unit handles the exchange of audio data within the training system. A speech recognition unit is trained to recognize AWACS terminology. All of these elements are in data communication such that a student may select between training modes and such that the appropriate elements perform the tasks associated with the selected training mode.

The AWACS training system provides a combination of speech recognition, interactive courseware, speech recognition, and simulation and live exercises. The student may sit at a single console and select between training modes, without the need for any system reconfiguration.

The integration of these training modes into one training system ensures that trainees build appropriate mental models. These mental models enable them to rapidly interpret all the sensory inputs they will receive in actual AWACS missions. They develop situational awareness of all aspects of air engagement. This awareness includes awareness of the position and state of aircraft, of the general military and political situation, the type of mission assigned to each specific aircraft; the objectives and target locations for each mission, the intentions of the pilots, the atmospheric conditions affecting their radar, and the capabilities of the aircraft radar and communications equipment. The trainees receive training in verbal communications skills and practice extensively so that they can become mission-ready on the ground.

Prior AWACS training has required the use of different computers or other platforms for each mode of training, resulting in a heterogeneous configuration that is expensive to support and maintain. The AWACS training system of this invention uses a unique approach to overcoming these problems by combining all training modes on a single platform.

DETAILED DESCRIPTION OF THE INVENTION

Figure 1:
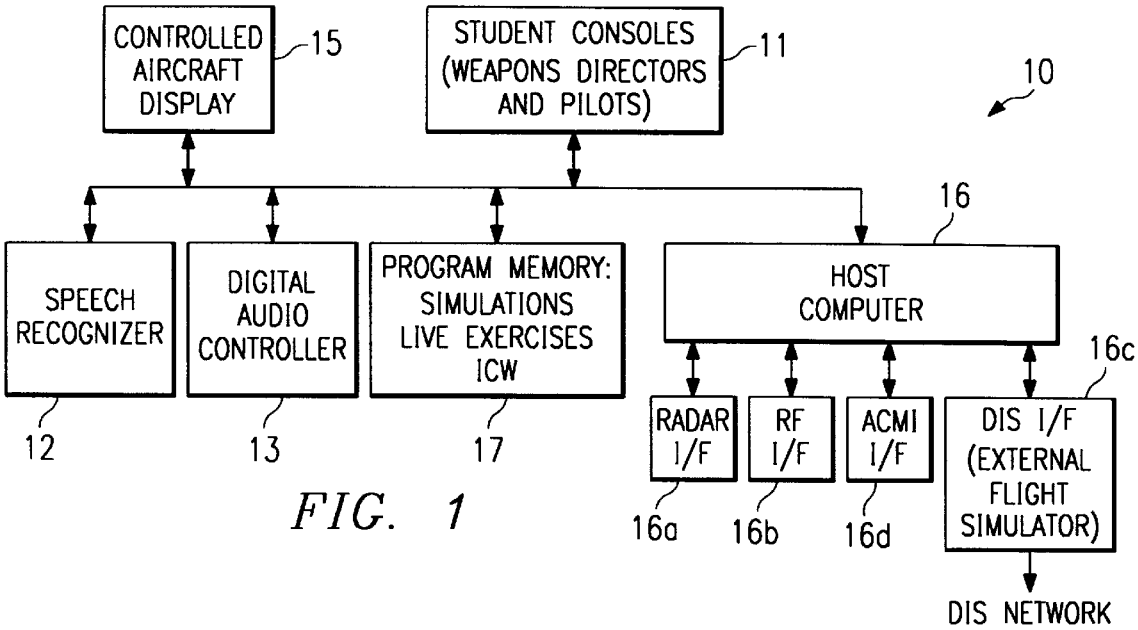
FIG. 1 is a block diagram of an AWACS training system in accordance with the invention.

FIG. 1 is a block diagram of an AWACS training system 10 in accordance with the invention. As explained in the Background, "AWACS" is the acronym for Airborne Warning and Control Systems. In addition to providing supplemental training, system 10 models a real-life AWACS system, which, in actual operation in an aircraft, comprises sophisticated radar equipment carried on a surveillance aircraft. The AWACS system is used to control both air and ground operations. It is operated by a number of weapons directors in the aircraft, whose tasks include directing other aircraft in the region of coverage. Aircraft track data appears on the AWACS console as two-dimensional symbology.

The persons that use system 10 are persons in training to be AWACS "weapons directors". The most critical skill to be learned is how to maintain situational awareness of the four-dimensional air environment during a military engagement. This situation awareness permits recognition of tactics being employed during an engagement, anticipation of a pilot's needs, and servicing those needs. While they are communicating, both pilot and weapons director must understand what is taking place in the air situation. Until now, the students gained this knowledge solely through mission experience.

System 10 is designed to ensure that AWACS students learn to form appropriate mental models of the air situation and order of battle. It improves the situational awareness of the student through a combination of training processes aimed at producing students who are skilled job performers, that is, mission-ready.

The main hardware components of system 10 comprise a bank of student consoles 11, digital audio controller 13, a controlled aircraft display station 14, and a host computer 15. Training mode software components are stored in a memory 17, which stores programming for a number of training modes, described generally in FIG. 1 as interactive courseware (ICW), simulation, and live exercise programming. Another software component is a voice recognizer 12. The storing of these software components in the same memory 17 or in distributed memory 17 is a design choice and the various possibilities for the physical location of memory 17 within system 10 are considered equivalent.

Student consoles 11 include both weapons director consoles and pilot consoles (for simulated operations of pilots of aircraft being directed by the AWACS). Each console 11 is driven by a workstation, such as a Silicon Graphics Indigo II. Each console 11 has appropriate hardware and software for rendering two dimensional and three dimensional graphics displays.

The weapons director consoles 11 replicate the consoles on an AWACS aircraft including switch panels, keyboard, trackball, situation display, and voice communications. The specific consoles emulated are known as E-3B/C Block situation display consoles.

The pilot consoles 11 allow an operator to control one or more simulated aircraft. In the embodiment of this description, the operator may to fly up to ten aircraft via autopilot commands or a single aircraft hands-on through aircraft-type throttle and sidestick controllers. Each pilot console 11 provides voice communications, a repositionable map display, heads-up display, fire control radar display, and a horizontal situation indicator.

The consoles 11 are programmed to provide the display interface for training system 10. Each provides for switching between the various training modes discussed below in connection with FIG. 2. Each has appropriate hardware and software for radar display generation, training exercise data management, and audio input and output.

Voice recognizer 12 receives audio input from consoles 11. It is trained to recognize words and phrases used during AWACS missions and to communicate with the interactive courseware and simulation programming so appropriate responses can be made to the student via console 11.

The digital audio controller 13 provides multiple channels for simulated UHF radio communications (with pilots) as well as for simulated intercom communications (with other weapons directors). As explained below in connection with FIG. 4, audio controller 13 supports DIS voice PDUs and has performs voice channel management, where channels are selected based on mission planning information for a given simulation. Each channel is identified by a separate frequency number or code (i.e., UHF 321.6 or Blue4). The weapons director can operate a number of tactical frequencies and a "guard" channel simultaneously. Each tactical frequency will be programmed to a specific "push" or channel. An aircraft simulator radio is "tuned" to any of the preplanned frequencies so that the aircraft can communicate with a student at a weapons director console 11. Frequencies are identified in the DIS voice PDUs and routed to the appropriate radio "push".

The controlled aircraft display 15 generates simultaneous radar and aircraft out-the-widow displays. It may be used during a simulation or live exercise for real-time viewing of a training mission. Or it may be used for debriefing upon completion of a simulation or live exercise. A radar scope display (two dimensional) is displayed side by side with a computer-generated visualization of the air situation (three-dimensional). Display 15 is further explained below in connection with FIG. 5.

Host computer 16 is a computer such as the Silicon Graphics Challenge L. Host computer 16 executes the AN/APY-2 radar and AN/APY-103 Mark XII IFF models. In the configuration of this description, host computer 16 is active during combined simulation and live exercise training modes. In the combined simulation training mode, host computer 16 provides for communications between consoles 11 and exchanges data with an external flight simulation system. In the live exercise mode, host computer 16 exchanges data with live aircraft and their pilots.

The various hardware components of system 11 are in data communication. As explained below in connection with the various training modes, the specific data exchanges to and from any one console 11 or host computer 16 may vary depending on the training mode.

Host computer 16 has several interfaces for external communications. These are a radar interface 16*a*, radio interface 16*b*, DIS interface 16*c*, and ACMI interface 16*d*.

The DIS (distributed interactive simulation) interface 16*c* permits each console 11 to communicate with an external flight simulator, such as those available from McDonnell Douglas Training Systems Company. In the embodiment of this description, the DIS connection is via a LAN (local area network). The information transfer for DIS data is discussed below in connection with FIG. 4.

The radar, radio, and ACMI interfaces 16*a* 16*b*, and 16*d* are used during the live exercise training mode. The radar interface 16*a* is essentially a modem connection for receiving air traffic data from an ARSR-4 radar. The radio interface 16*b* receives voice communication with actual aircraft. The ACMI interface 16*d* accepts data from aircraft maneuvering and instrumentation (ACMI) ranges for debriefing live exercises.

Figure 2:
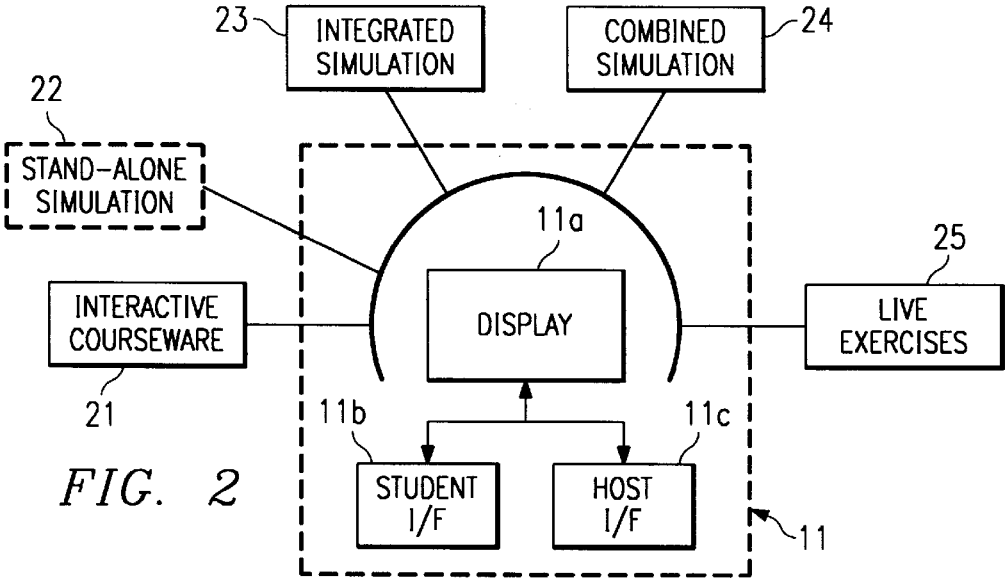
FIG. 2 illustrates a single AWACS training console and various training modes that it is programmed to execute.

FIG. 2 illustrates a single console 11 and functionally illustrates how a student may select between the training modes stored in memory 17. As indicated, console 11 has a display 11*a*, user interface 11*b*, and host interface 11*c*. The training modes are executed by the following processes: interactive courseware 21, stand-alone simulation 22, integrated simulation 23, combined simulation 24, and live exercises 25.

For certain training modes, such as the interactive courseware mode and certain simulation modes, the process control is primarily a function of the consoles 11. In other simulation modes and in the live exercise mode, process control is primarily a function of the host computer 16. When a student select a training mode, host computer 16 recognizes those modes in which it is required to transfer data between consoles 11 and to and from external sources via interfaces 16*a*–16*d*. Also, although only a single console is illustrated in FIG. 2, a feature of the invention is that any console 11 can be running any of the training modes simultaneously with other console(s) running the same or different training modes. As explained below in connection with specific training modes, host computer 16 is programmed to recognize those training modes in which it is required to provide data transfers.

As a result of this selectivity between training modes, instruction may be blended with practice. Practice exercises proceed from simple one-versus-one intercepts to complex live tactical intercepts. All this occurs without the need for system reconfiguration and without requiring the student to change consoles.

The interactive courseware mode 21 provides multimedia lessons in support of selected training objectives. The multimedia techniques include three dimensional and two dimensional computer graphics, voice-over audio, and speech recognition. The interactive aspects of the courseware mean that it retrieve questions, handles answers, and performs other interactive courseware tasks.

Interactive courseware lesson content is delivered to the student at the appropriate point. For example, on a given training day, the student will complete certain lessons before engaging in simulation exercises. Thus, prerequisite theory and instruction required for task performance is provided when it is needed.

Figure 3:
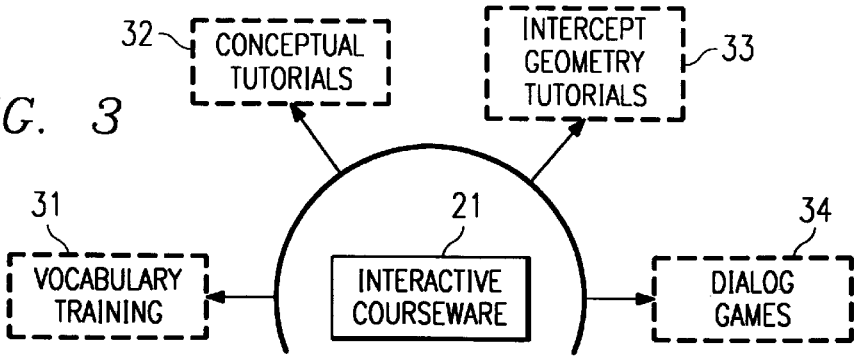
FIG. 3 illustrates various interactive courseware processes that may be selected during the interactive courseware training mode.

FIG. 3 illustrates various courseware processes within the courseware mode 21. These processes provide the following various lesson types: lessons that teach the unique vocabulary used to communicate with pilots, conceptual tutorials, geometry tutorials, and a dialogue game. Each of these lesson types is capable of being implemented with three-dimensional graphic displays that help the student understand difficult concepts. For example, as explained below, the conceptual tutorials use three-dimensional graphics to teach intercept and stern geometry, aircraft forces, turn radius, weather hazards, barometric pressure and altimetry, and aircraft tactics and maneuvers.

The vocabulary training process 31 teaches code words and phrases. There are perhaps 1000 or more words and phrases that are unique to AWACS. The vocabulary lessons begin by teaching the student individual words and phrases and progress to teaching the student how to integrate speaking and listening skills with other performance activities. The student listens to messages from others to develop situational awareness and to know when information is being requested. The student is asked to provide the correct information in his own transmissions.

The vocabulary training process differentiates between words spoken by a pilot or others and words spoken by a weapons director. For words normally heard by the weapons director, the process provides a radio transmission via a speaker at console 11. Each transmission contains specific word the student must learn. The student selects, from a choice of alternatives displayed at console 11, the answer that best describes the situation. For words normally spoken by the weapons director, the process displays a sentence at console 11. The sentence has a particular word missing and the student is expected to speak the correct word. The speech recognition system within system 13 evaluates judge the student's response and provides appropriate feedback.

Once the student has learned individual words that form the AWACS vocabulary, the student proceeds with radio transmission rehearsal activities where he looks at the radar scope display of console 11 and listens to a radio transmission spoken by a pilot, air traffic controller, or senior weapons director. The student must understand the situation and content of the communication in order to correctly respond. The student is required to access the correct communication channel at console 11 and speak directly back to the pilot, air traffic controller, or senior weapons director. Once the student has spoken, his words are evaluated by the speech recognizer 12 and he receives feedback. At this point, he can repeat the transmission, listen to how an experienced weapons director would respond, continue, or quit. The student can practice each individual radio transmission as many times as desired. The radio transmission can be simulated, based on data from digital audio unit 13, or live.

The conceptual tutorial process 32 enhances student understanding of concepts that are difficult to grasp through a lecture or printed texts. A particular characteristic of these tutorials is their use of audio and dynamic two-dimensional and three-dimensional graphic simulations to explain difficult concepts. The conceptual tutorials 32 include tutorials for the following subjects:

Aircraft Forces—This lesson presents the relationship between wind, speed, angle of bank, and turn radius. The display consists of a bird's-eye-view of dynamic three-dimensional graphic animation showing aircraft executing turns as well as two-dimensional radar scope display, the student will develop an appropriate mental model in which he can relate aircraft performance to his display.

Radar Fundamentals—This lesson consists of two sections: Types of Radar and Identification Friend or Foe (IFF) Selective Feature Antenna. The radar fundamentals tutorial uses audio and dynamic and static two-dimensional displays as well as dynamic three-dimensional animation to help the student understand the concepts. Where appropriate, AWACS radar scope displays and F-15 scope displays are provided along with the animation to help the student relate three-dimensional concepts to his radar display as well as the pilot's radar display.

Barometric Pressure and Altimetry—This lesson illustrates the importance of aircraft having their altimeters set to the correct barometric pressure. The tutorial uses two dimensional static diagrams with dynamic three-dimensional aircraft to explain the importance of correct altimeter settings and to show the results of failure to use the correct altimeter settings.

Communications Systems—This lesson uses static and dynamic two-dimensional graphics to explain the capabilities and limitations of voice communication systems and frequency agile systems.

FAA Airspace—This lesson uses a three-dimensional static display of an airspace and three-dimensional dynamic display of aircraft, along with audio containing relevant radio transmissions to foster student understanding of the correct sequence of air traffic control procedures for military aircraft training missions. As the student hears the radio transmissions and explanations, he will be able to see the scenario of the aircraft traveling into and out of the airspace. When the scenario is completed, the student will see a menu of radio transmission events. When the student selects an event, he will see the aircraft in the airspace and hear the appropriate radio transmission. This strategy allows the student to review each procedure to enhance his understanding of the procedures as well as helping the student to learn the appropriate radio transmissions.

The intercept geometry tutorials 33 of the interactive courseware process 21 teach the geometry used in cutoff and stern attacks. Interactive exercises provide a format in which the students apply their understanding to decision making and learn how to provide appropriate information to the pilot during cutoff and stern attacks.

There are four intercept geometry tutorials within process 33: Stern Overview, 180-150 Heading Crossing Angle (HCA) Sterns, 150-120 HCA Sterns, and 120-190 HCA Sterns. Each exercise presents a scenario with two-dimensional AWACS symbology and voice-over narration. The scenario consists of a series of events in which the student is required to make decisions and provide information. The student answers a series of questions verbally. For example, in some lessons, the student must identify the required fighter headings, the direction of turn, and the target's aspect. In other lessons, the student must identify the bearing to which he will fly the fighter, the heading associated with the HCA, whether a heading correction is required based on the current geometry, target aspect, and correct direction of turn.

The intercept geometry tutorial process 33 has programming that draws lines during initial exercises, to help the student answer the questions. As the tutorial continues, fewer lines are drawn, thereby incorporating guided and unguided practice into the exercises.

The dialogue game process 34 of the interactive courseware process 21 is for use after the basic vocabulary training process 31, to motivate the student to continue practicing listening and speaking skills. The game process 34 contains all the words the student learned during the vocabulary process 31 as well as some advanced radio transmissions. Audio system 13 receives the student responses and uses speech recognition to judge them and provide feedback during the game. The dialog game process 34 is further programmed to compute and compare the scores of the students.

Referring again to FIG. 2, three of the training modes provided by system 10 are simulation modes—stand-alone, integrated, and combined. These modes make use of the simulation programming stored in memory 17 of FIG. 1. In a typical configuration, memory 17 with appropriate simulation programming resides on the consoles 11 for stand-alone and integrated simulations and additional memory 17 resides on the host computer 16 for combined simulations. However, the physical location of memory 17 is a design choice. The simulation programming includes a radar model, auto-pilot model, and pseudo-pilot model, each of which deliver simulation data to a console 11 for display.

The radar simulations model the AWACS radar. Specific equipment simulated by radar simulator 12 might be the AWACS AN/APY-2 radar and the AN/APX-103 Mark XII identify friend or foe (IFF) interrogator. Using aircraft parameter data, a radar simulation detects targets, generates position, altitude, velocity, and identification of aircraft, and provides the required information to consoles 11 for the radar display. Each aircraft entity included in the radar simulator model consists of radar, IFF, and symbology data. The radar simulation includes the effects of chaff and clutter and simulates the ten second scan of the AWACS radar. The IFF interrogator is simulated for every ten second scan and simulates IFF/SIF (selective identification function) pulses from the aircraft transponder for display on console 11. Radar targets and IFF tracks are multi-scan correlated to generate realistic symbology on the display.

The stand-alone simulation process 22 involves a weapons director student at a single console 11. The process receives input from the student representing direction by the student of one or more aircraft. The student's audio input is delivered to speech recognizer 12, which interprets audio commands and delivers its interpretation to auto-pilot programming that is part of the simulation programming stored in memory 17. The auto-pilot programming maneuvers simulated aircraft in response to the student. Simulated aircrew audio transmissions are delivered to the console 11 from digital audio unit 13. Simulated radar from radar simulation programming in memory 17 is displayed on console 11. Additional aircraft and their pilots may be included in the display at console 11 in accordance with recorded missions.

Another simulation training mode is provided by an integrated simulation process 23. This process 23 uses both a weapons director console 11 and a pilot console 11. They communicate by means of digital audio unit 13. The process 23 receives input from a weapons director student at a weapons director console 11, who directs one or more aircraft that are controlled by a pseudo-pilot at a pilot console 11. The pilot console 11 delivers position data to the radar simulation programming in memory 17, which provides radar simulation data for display at console 11. Aircraft participating in an integrated simulation exercise that are not controlled by the pseudo-pilot follow simulated aircraft tracks provided by the auto-pilot simulation programming. However, the pseudo-pilot can take control of these simulated aircraft at any time.

A fourth type of training mode is provided by a combined simulation process 24. This process permits a number of weapons director students at a number of consoles 11 to direct simulated aircraft. For this mode, host computer 16 handles the radar simulation programming. The combined simulation exercise supports up to 960 different simulated tracks. Each simulated aircraft within a combined simulation exercise may be flown by an external simulator, controlled at a pilot console 11, or by simulation programming residing in memory 17.

Figure 4:
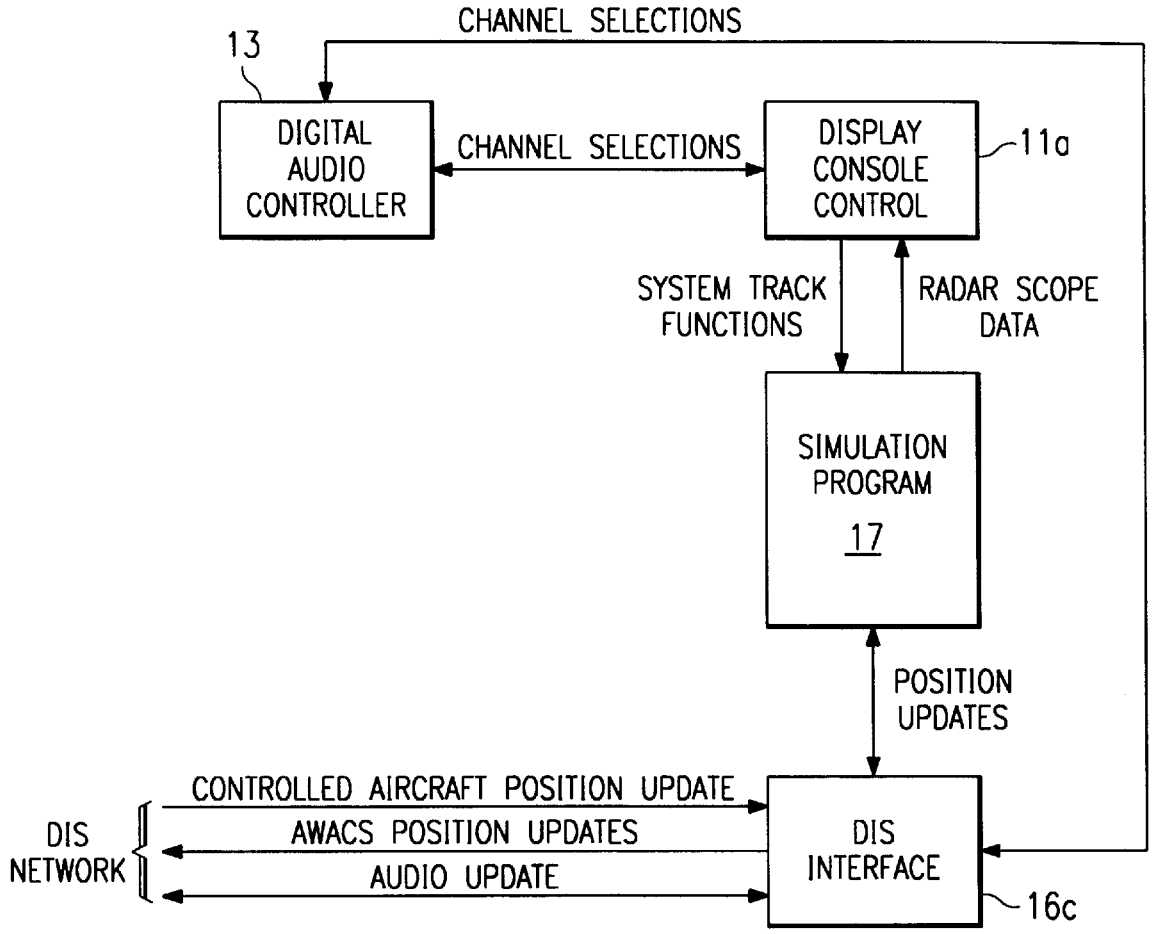
FIG. 4 illustrates the data transfer process when the AWACS system communicates with an external flight simulator.

FIG. 4 illustrates the data transfer process within system 10 when system 10 communicates with an external simulation system during simulation training modes. In the example of FIG. 4, the external simulation system is a DIS system. A DIS network serves as the communication mechanism between system 10 and a simulator.

DIS interface 17 receives position update data from DIS simulators, with the data representing the position of aircraft being controlled by a weapons director student at a console 11. The DIS interface delivers data representing the position of the AWACS aircraft. Messages from the DIS network are forwarded to the appropriate console(s) 11 according to the simulation exercise in which a simulated aircraft is participating.

DIS interface 17 complies with protocol standard 2.0.4 and handles all protocol for the DIS network communication. The DIS interface 17 handles data in the form of protocol data units (PDUs), which permit system 10 to operate in a variety of potential DIS environments. The AWACS console computer's primary method of communication is over an Ethernet local area network (LAN). Communication between simulation components residing on a single console 11 is implemented with local and shared memory.

The following is a brief description of the DIS input and output messages for system 10 via host computer 16:

Entity State (ES) PDU—System 10 will output the ES PDU for the E-3 in order for other simulations in the DIS environment to represent location, orientation, etc. The system 10 will also output scripted aircraft paths as ES PDUs. The system 10 will receive ES PDUs from entities on the DIS network such that those aircraft can be represented in the simulated environment.

Electromagnetic Emission PDU—System 10 outputs the Emission PDU for the simulated E-3 radar in order for other simulations in the DIS environment to represent the E-3 radar location and operational parameters. System 10 does not process incoming Emission PDUs and therefore cannot be jammed.

Radio Communications Protocol—System 10 transmits and receives voice radio communications using the transmitter and Signal PDUs. The Transmitter PDU is used to communicate the state of a particular radio transmitter. The Signal PDU contains the digitized audio carried by the simulated radio transmission. DIS interface 17 provides the capability for 16 independent frequencies for radio communications.

IFF PDU—System 10 outputs the IFF PDU in order to provide other entities in the DIS environment with information on the active transponder state in the simulation. It will also receive IFF PDUs from aircraft entities in the DIS environment in order to represent them in the simulated environment. The IFF PDU is currently in draft form; however, it is included in an Institute of Electrical and Electronics Engineers (IEEE) draft standard.

The simulation programming in memory 17 receives aircraft position data from the DIS interface 17, transforms the data to a radar scope format, and transfers the data to the appropriate console 11 for display. System track functions such as track assignments and data requests are sent from the display console 11 to the auto-pilot simulation programming. The simulation programming and participating F-15 ACES simulators exchange aircraft position update messages via the DIS network interface 17. Throughout the exercise, voice, radar scope and aircraft position data are recorded and may be replayed. The display console's audio channel selections are forwarded to the a voice channel control component 13*a* of the audio system 13 and routed to the DIS interface 17.

Referring again to FIG. 2, a fifth training mode of system 10 is provided by a live exercises process 25. This process permits one or more weapons director students to direct actual aircraft via console(s) 11. Actual aircraft position data are provided to the AMS system from an ARSR-4 radar via radar interface 16*a*. The ARSR-4 radar is capable of providing position data for up to 800 tracks. Audio data from the console 11 is delivered to aircraft radio via the radio interface 16*b*. As stated above in connection with FIG. 1, ACMI interface may also be used to receive ACMI data.

During both combined simulations and live exercises, host computer 16 has the primary process control. At any console 11 at any time, a student may elect to join an ongoing combined simulatoin or live exercise in which one or more student(s) at their respective console(s) are already participating.

Referring again to FIG. 1, system 10 has a controlled aircraft display station 15, which correlates the two-dimensional AWACS display and radio transmissions with a three-dimensional scene of the aircraft being controlled by an AWACS weapons director. In this manner, system 10 ensures that students form appropriate mental models of the actual air situation.

Figure 5:
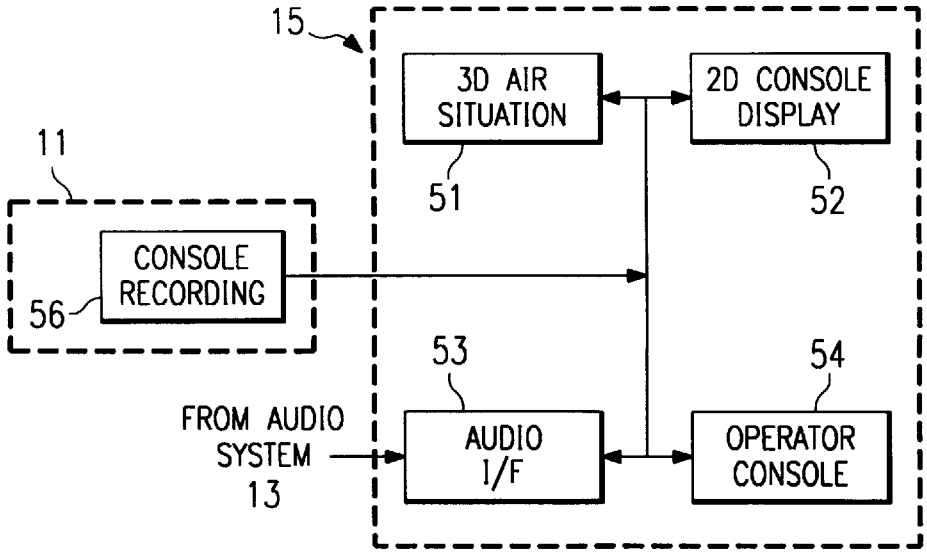
FIG. 5 is a functional block diagram of the controlled aircraft display unit of the system of FIG. 1.

FIG. 5 is a functional block diagram of display station 15. It has two video displays 51 and 52, an audio interface 53, and an operator interface 54. One video display 51 provides a three-dimensional visualization of the air situation. The operator interface 54 controls this display 51, and allows the operator to position viewpoint, change the appearance of the aircraft, display history trials, and change the appearance of terrain. The other video display 52 displays the same radar scope data as does a console 11 and that corresponds to the air situation. The accompanying audio is also provided.

Display station 15 may be used during an integrated simulation exercise, a combined exercise, or a live exercise. Also, data recorded from these exercises can be saved and recorded for debriefing at display station 15.

For debriefing, it is assumed that the console 11 being debriefed has a multimedia recording device 56 for storing audio and video data for playback.

Other Embodiments

Although the invention has been described with reference to specific embodiments, this description is not meant to be construed in a limiting sense. Various modifications of the disclosed embodiments, as well as alternative embodiments, will be apparent to persons skilled in the art. It is, therefore, contemplated that the appended claims will cover all modifications that fall within the true scope of the invention.

What is claimed is:

1. A training system for training students to be weapons directors of an AWACS system, comprising:

a memory for storing interactive courseware programming, simulation programming, and live exercise programming, thereby providing different training modes;

at least one student weapons director console, said weapons director console being a replica of an AWACS console and being programmed such that a student may select between said training modes;

a host computer for receiving simulation data from an external flight simulator, as well as radar and audio data from real world aircraft;

a digital audio system for handling the exchange of audio data within said system;

a speech recognition unit trained to recognize AWACS terminology; and communications links whereby each of the above said elements is capable of receiving and delivering data as appropriate for a selected training mode.

2. The system of claim 1, wherein said simulation programming is stand-alone simulation programming.

3. The system of claim 1, wherein said simulation programming is integrated simulation programming.

4. The system of claim 1, wherein said simulation programming is combined simulation programming.

5. The system of claim 1, further comprising at least one pseudo-pilot console, and wherein said simulation programming provides controlled aircraft data, and wherein said communication links provide data transfer between said psuedo-pilot console, at least one weapons director console, and said memory during said simulation training mode.

6. The system of claim 1, wherein said communications links provide data transfers between a weapons director console and said voice recognition unit during said interactive courseware training mode.

7. The system of claim 1, wherein said communications links provide data transfers between a weapons director console and said voice recognition unit during said simulation training mode.

8. The system of claim 1, wherein said digital audio system provides simulated radio transmissions during said simulation training mode.

9. The system of claim 1, further comprising a controlled aircraft display station programmed to provide a simultaneous two-dimensional display of a weapons director console and a corresponding three-dimensional display of aircraft being controlled by that console.

10. A method of using one or more computers to train students to be weapons directors of an AWACS system, using at least one replicated AWACS weapons director console, comprising the steps of:

storing interactive courseware programming in memory;

storing simulation programming in memory, wherein said simulation programming provides data for aircraft flight simulation and for AWACS radar displays;

storing live exercise programming in said memory, wherein said live exercise programming receives aircraft position data from a radar and voice data from said aircraft;

whereby said storing steps result in a stored set of training modes;

storing student interface programming in memory, whereby a student at said weapons director console may select between any one of said training modes.

11. The method of claim 10, wherein said simulation programming is stand-alone simulation programming.

12. The method of claim 10, wherein said simulation programming is integrated simulation programming.

13. The method of claim 10, wherein said simulation programming is combined simulation programming.

14. The method of claim 10, further comprising the step of providing a host computer having programming such that process control of said training modes is distributed between said weapons director console and said host computer.

15. The method of claim 10, further comprising the step of providing at least one pseudo-pilot console, and wherein said simulation programming provides psuedo-pilot data to said weapons director console.

16. The method of claim 10, further comprising the step of providing voice recognition programming for use during said interactive courseware training mode.

17. The method of claim 10, further comprising the step of providing voice recognition programming for use during said simulation training mode.

18. The method of claim 10, further comprising the step of providing means for simulated radio transmissions during said simulation training mode.

19. The method of claim 10, further comprising the step of providing means for receiving real world radio and radar data from an aircraft during said live exercise mode.

20. The method of claim 10, further comprising the step of providing means for displaying a three-dimensional scene of aircraft controlled by said weapons director console.

* * * * *